US005988809A

United States Patent [19]

Yokoi et al.

[11] Patent Number: 5,988,809

[45] **Date of Patent: *Nov. 23, 1999**

[54] RECORDING APPARATUS WITH SYSTEM FOR STACKING , SUPPLYING AND GUIDING RECORDING MEDIA

[75] Inventors: Katsuyuki Yokoi, Yokohama; Koji Terasawa, Mitaka; Makoto Takemura, Tokyo; Koichiro Kawaguchi, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,775

[22] Filed: May 5, 1997

Related U.S. Application Data

[63] Continuation of application No. 07/942,035, Sep. 8, 1992, abandoned.

[30] Foreign Application Priority Data

| | | | |
|---|---|---|---|
| Sep. 12, 1991 | [JP] | Japan | 3-233042 |
| Sep. 12, 1991 | [JP] | Japan | 3-260579 |
| Oct. 21, 1991 | [JP] | Japan | 3-272694 |

[51] Int. Cl.[6] ..... B41J 2/01

[52] U.S. Cl. ..... 347/104; 271/124; 400/624

[58] Field of Search ..... 346/134, 145; 347/104; 271/113, 124; 400/624, 625, 629, 634, 636

[56] References Cited

U.S. PATENT DOCUMENTS

| | | |
|---|---|---|
| 3,339,916 | 9/1967 | Tregay . |
| 3,378,252 | 4/1968 | Springer . |
| 3,807,725 | 4/1974 | Bookless . |

(List continued on next page.)

FOREIGN PATENT DOCUMENTS

| | | |
|---|---|---|
| 0227116 | 7/1987 | European Pat. Off. . |
| 0332275 | 9/1989 | European Pat. Off. . |
| 58-47733 | 3/1983 | Japan . |
| 61-173969 | 8/1986 | Japan . |
| 62-191334 | 8/1987 | Japan . |
| 63-282030 | 11/1988 | Japan . |
| 1-060525 | 3/1989 | Japan . |
| 1-214541 | 8/1989 | Japan . |
| 2138785 | 10/1984 | United Kingdom . |

OTHER PUBLICATIONS

Dunning, "Mechanism For Latching A Paper Sheet Feeder To A Typewriter", IBM Technical Disclosure Bulletin, p. 3963 (Dec. 1981).

M.S. Robbins, "Buckle Effect Document Separator", IBM Technical Disclosure Bulletin, vol. 25, No. 1, p. 272 (Jun. 1982).

*Primary Examiner*—Benjamin R. Fuller
*Assistant Examiner*—Craig Hallacher
*Attorney, Agent, or Firm*—Fitzpatrick, Cella, Harper & Scinto

[57] ABSTRACT

A recording apparatus is provided with a paper supply stacker on which sheets are stacked and held, a recording head for effecting recording on the sheets fed out from the paper supply stacker, a flat support device for supporting the sheets during the recording by the recording head, and a discharged paper stacker onto which the sheets recorded by the recording head are discharged.

12 Claims, 13 Drawing Sheets

U.S. PATENT DOCUMENTS

| | | | |
|---|---|---|---|
| 4,027,872 | 6/1977 | Bueker . | |
| 4,031,995 | 6/1977 | Blum et al. . | |
| 4,164,376 | 8/1979 | Yarp . | |
| 4,273,456 | 6/1981 | Bisczat et al. . | |
| 4,372,699 | 2/1983 | Quinn, Jr. . | |
| 4,488,829 | 12/1984 | Hidaka . | |
| 4,492,371 | 1/1985 | Kan et al. . | |
| 4,540,297 | 9/1985 | Imaizumi et al. . | |
| 4,577,984 | 3/1986 | Yamamoto et al. . | |
| 4,619,388 | 10/1986 | Ono et al. . | |
| 4,634,265 | 1/1987 | Tada . | |
| 4,723,129 | 2/1988 | Endo et al. | 346/1.1 |
| 4,729,557 | 3/1988 | Kiyohara . | |
| 4,729,683 | 3/1988 | Staniszewski . | |
| 4,740,796 | 4/1988 | Endo et al. | 346/1.1 |
| 4,772,007 | 9/1988 | Kashimura . | |
| 4,854,757 | 8/1989 | Kikuchi . | |
| 4,946,298 | 8/1990 | Oka et al. . | |
| 4,968,016 | 11/1990 | Koyama . | |
| 4,986,525 | 1/1991 | Takagi et al. . | |
| 4,995,745 | 2/1991 | Yokoi et al. . | |
| 5,085,422 | 2/1992 | Sagara . | |
| 5,096,182 | 3/1992 | Kashimura . | |
| 5,105,210 | 4/1992 | Hirano et al. | 346/145 |
| 5,120,045 | 6/1992 | Kamezaki et al. . | |
| 5,126,764 | 6/1992 | Miyauchi et al. | 346/138 |
| 5,170,183 | 12/1992 | Hirabayoshi et al. | 346/134 |
| 5,294,958 | 3/1994 | Isobe et al. | 355/208 |

RECORDING APPARATUS WITH SYSTEM FOR STACKING , SUPPLYING AND GUIDING RECORDING MEDIA

This application is a continuation of application Ser. No. 07/942,035 filed Sep. 8, 1992, now abandoned.

BACKGROUND OF THE INVENTION

1. Field of the Invention

This invention relates to a recording apparatus for effecting recording on a recording medium, and more particularly to a recording apparatus capable of effecting recording of high quality with recording means brought close to a recording medium.

2. Related Background Art

Today, various recording systems have been developed and above all, the ink jet recording system which effects recording by discharging ink droplets in conformity with recording signals has recently been widely used because of the ease with which the compactness and low noise of the apparatus are realized.

In this ink jet recording apparatus, an example of which is shown in FIG. 9 of the accompanying drawings, a recording medium 51 is conveyed to a recording position L by a pair of conveying rollers 50*a* and 50*b* and the back of the thus conveyed recording medium 51 is supported by a paper guide 52 and also, an ink jet recording head 53 is driven to discharge ink droplets to the recording medium 51 in conformity with recording signals to thereby accomplish desired recording. After the recording, the recording medium 51 is discharged by a pair of discharge rollers 54*a* and 54*b*. In such a recording apparatus, ink droplets discharged from the recording head 53 are very minute and therefore, in order to eliminate the influence of wind or the like to the utmost to thereby obtain a high quality of recording, the distance between the recording head 53 and the paper guide 52 is made small. Design is also made such that the plane to which the paper guide 52 belongs and the point of pressure contact P between the pair of conveying rollers 50*a* and 50*b* and the point of pressure contact Q between the pair of discharge rollers 54*a* and 54*b* are on the same plane and the recording medium 51 is conveyed rectilinearly.

However, when paper is used as the recording medium 51 and ink is discharged for recording at high density, the paper 51 which has passed the recording area by the recording head 53 is bulged by the permeation of the ink. At this time, there is no escape for the bulged paper and therefore, the paper is expanded toward the recording head 53 side as indicated by the dot-and-dash line in FIG. 9. If this expansion becomes great, the recording head 53 may rub against the recording medium 51 during scanning to thereby stain the recording medium 51 with the recording ink. In an extreme case, the recording head 53 may be caught by the bulged recording medium 51 to thereby cause the jamming of the recording medium. Therefore, distance between the recording head 53 and the paper guide 52 has been limited in being made small.

FIG. 10 of the accompanying drawings shows another example of the prior art.

In FIG. 10, the reference numeral 401 designates a recording head for effecting recording, the reference numeral 402 denotes a carriage carrying the recording head 401 thereon and effecting main scanning in a direction perpendicular to the plane of the drawing sheet, the reference numeral 403 designates a carriage shaft along which the carriage slides, the reference numeral 406 denotes a conveying roller for holding a sheet S and conveying it in the sub-scanning direction, the reference numeral 407 designates a follower roller for urging the sheet S against the conveying roller 406 to thereby create a conveying force, the reference numeral 408 denotes a paper discharging roller for discharging the sheet S, the reference numeral 409 designates a paper discharging follower roller adapted to be urged against the paper discharging roller 408 to thereby create a conveying force, and the reference numeral 410 denotes a recording position at which recording is effected on the sheet S by the recording head 401. The reference numeral 421 designates a supply stacker on which sheets S are stacked, the reference numeral 417 denotes a paper feeding roller for feeding the sheets S on the feeding stacker 421, and the reference numeral 423 designates a discharged paper stacker on which the discharged sheets S are stacked.

The sheets S stacked on the supply stacker 421 are picked up one by one by the paper feeding roller 417 and are fed to the conveying roller 406, and thereafter are conveyed to the recording position 410 by the conveying roller 406. Recording is effected on the sheets S by the recording head 401, whereafter the sheets S are discharged from the recording position 410 by the paper discharging roller 408 and are stacked on the discharged paper stacker 423.

In this example of the prior art, the sheet S is fed to the recording position 410 from the side opposite to the recording head 401, and the discharge direction was parallel to the plane of the recording position or opposite to the recording head 401. In the above-described prior-art recording apparatus, when a rigid sheet such as a postcard is used, the sheet is fed to the recording position 410 from the side opposite to the recording head 401, and this has led to the disadvantage that when the leading end of the sheet is conveyed to the recording position 410 through the point of pressure contact between the conveying roller 406 and the follower roller 407, the leading end of the sheet floats up from the recording position 410 due to the rigidity of the sheet and is liable to contact the recording head 401 when the head effects main scanning, thereby becoming jammed. There has also been the disadvantage that when the sheet is conveyed by only the paper discharging roller 408 after the trailing end of the sheet has passed the point of pressure contact between the conveying roller 406 and the follower roller 407, the trailing end of the sheet likewise floats up from the recording position 410 due to the rigidity of the sheet and is liable to contact the recording head 401 when the head effects main scanning, thereby becoming jammed.

Also, in an ink jet recording apparatus, and particularly a color printer, design has heretofore been made such that as a method of preventing paper floating after recording and imparting tension to a recording surface, paper is pulled by a roller upstream of the recording surface or is adsorbed by air suction or the like. Also, a spur has been provided in a recording medium discharging portion to contrive a countermeasure for paper floating.

The above-described roller construction upstream of discharged paper, however, can only cope with coated paper, and cannot cope with OHP and plain paper which are liable to be print-stained. Also, the construction for air-sucking the recording medium leads not only to the bulkiness of the apparatus, but also to the problem of noise. On the other hand, in an ink jet recording apparatus of the spur construction, there has arisen the problem that by the shape of the projected portion of the spur, ink adhering to the projected portion of the spur stains the white or otherwise colored recording surface of a recording medium such as coated paper, plain paper or OHP. Since the painted surface of coated paper is made of a metallic oxide or a metallic compound of the Si family or Mg family, this projected portion comes to effect paper conveyance at a higher speed, and even if the spur is made of an SUS material, the spur has come to be abraded and slip relative to the recording surface onto which ink has been shot, thereby causing image deterioration. The abraded projection would cause the surface of the paper to be more stained with the ink adhering to the projection.

Also, in the case of a color printer, the influence of the spur in the paper conveying portion differs from that in a monochrome printer, and a slight amount of ink adhering to the spur again becomes wet with the ink on the recording paper shot onto the other color end by the spur being rotated once and thus, color mixing occurs to stain the recording surface. The tip of the projection of the spur becomes rounded from the abrasion of a mold in the punching of a press and the portion thereof which contacts the surface of the paper becomes large, and on OHP, plain paper or the like on which it is difficult for ink to be fixated, the ink is greatly wet with the ink on the surface of the paper and therefore, print stain by the spur is liable to occur. Particularly on OHP, slip occurs between the spur and the surface of unfixated ink liquid on the surface of the paper and a trace like a drawn line is liable to be created by the relative speed. In an ink jet color printer, not only coated paper but also OHP, plain paper or the like is recently used as a recording medium and therefore, when printing is effected on a recording medium of bad fixation, the influence of the abrasion of the projection of the spur by the painted layer of the recording medium occurs more readily and the stain of the printed surface becomes remarkable.

FIGS. 11 and 12 of the accompanying drawings schematically show the stain of the printed surface. FIG. 11 shows the re-melting stain of wet red ink (R) by black ink (Bk). FIG. 12 shows black dots and black lines due to sliding in a case of a sheet 522 of bad fixativeness. Also, FIGS. 13, 14 and 15 of the accompanying drawings show the relation between OHP and the spur, and in these figures the letter C designates a coat layer, and represents the manner in which sliding becomes liable to occur due to the abrasion of a spur projection 509*a*.

SUMMARY OF THE INVENTION

It is an object of the present invention to solve the above-noted problems peculiar to the prior art and to provide a recording apparatus in which even if a recording medium is bulged, recording means does not rub against it or the recording medium is not jammed and which can accomplish recording of high quality with the recording medium brought close to the recording means.

It is also an object of the present invention to provide a recording apparatus in which the occurrence of the warping of a sheet is suppressed at a recording position and the jamming by the warping of the sheet can be prevented.

In order to solve the above-noted problems, a recording apparatus according to the present invention has recording means for effecting recording on a recording medium, a pair of conveying rotatable members for conveying said recording medium to a recording position by said recording means, a pair of discharging rotatable members for discharging the recording medium which has passed through said recording position, and a planar recording position defining member for supporting said recording medium at said recording position. Thus, the recording apparatus is characterized in that the point of pressure contact between said pair of conveying rotatable members is located on a plane to which said recording position defining member at said recording position belongs or a side closer to said recording means than said plane, and the point of pressure contact between said pair of discharging rotatable members is located on a side farther from said recording means than the plane to which said recording position defining member at said recording position belongs.

Also, a recording apparatus according to the present invention is provided with a paper supply stacker on which sheets are stacked, a recording head for effecting recording on the sheets fed from said paper supply stacker, flat support means for supporting the sheets during the recording by said recording head, and a discharged paper stacker onto which the sheets recorded by said recording head are discharged. Thus, the recording apparatus is characterized in that said paper supply stacker and said discharged paper stacker are disposed in direction inclined by 90° or less toward said recording head with respect to a plane to which said support means belongs.

Also, preferably, said support means may be inclined with respect to a horizontal plane, said paper supply stacker may be inclined with respect to the paper feeding direction so that the downstream side thereof may underlie, and said discharged paper stacker may be inclined with respect to the paper discharging direction so that the upstream side thereof may underlie.

DESCRIPTION OF THE PREFERRED EMBODIMENTS

Figure 1:
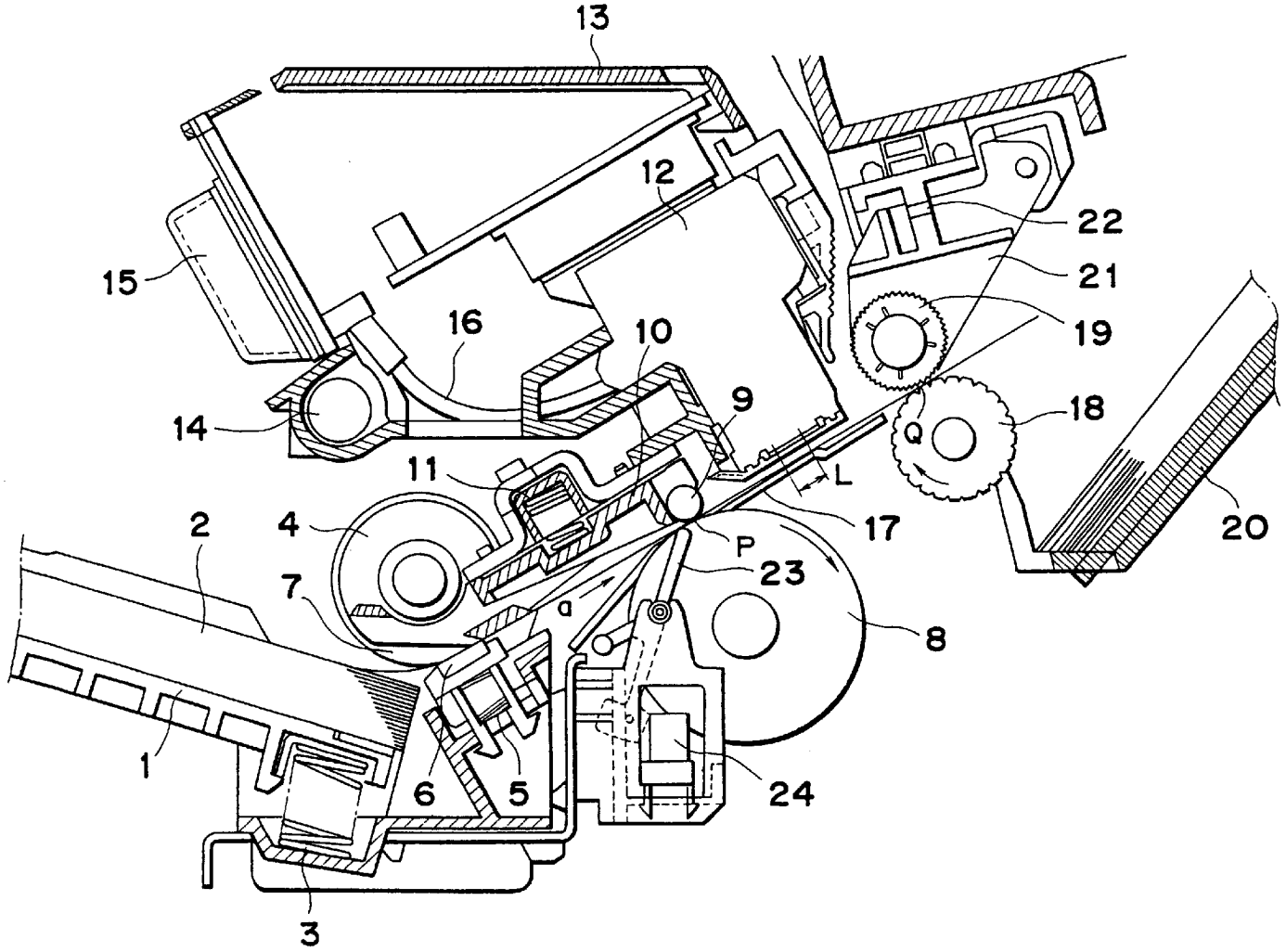
FIG. 1 is a schematic cross-sectional view showing the general construction of a recording apparatus according to a first embodiment of the present invention.
Figure 2:
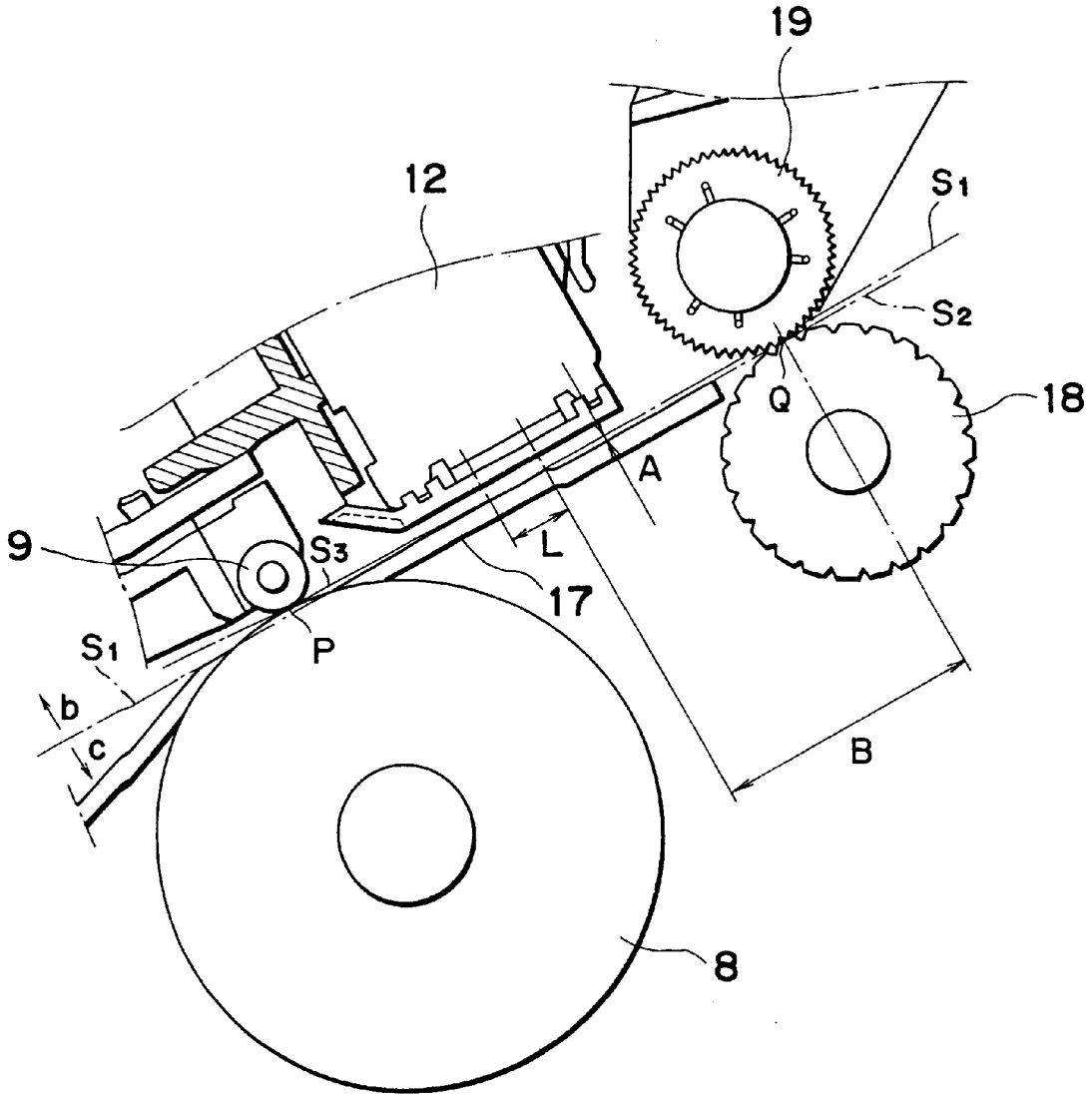
FIG. 2 is an enlarged illustration of the essential portions of a recording portion in the first embodiment.
Figure 3:
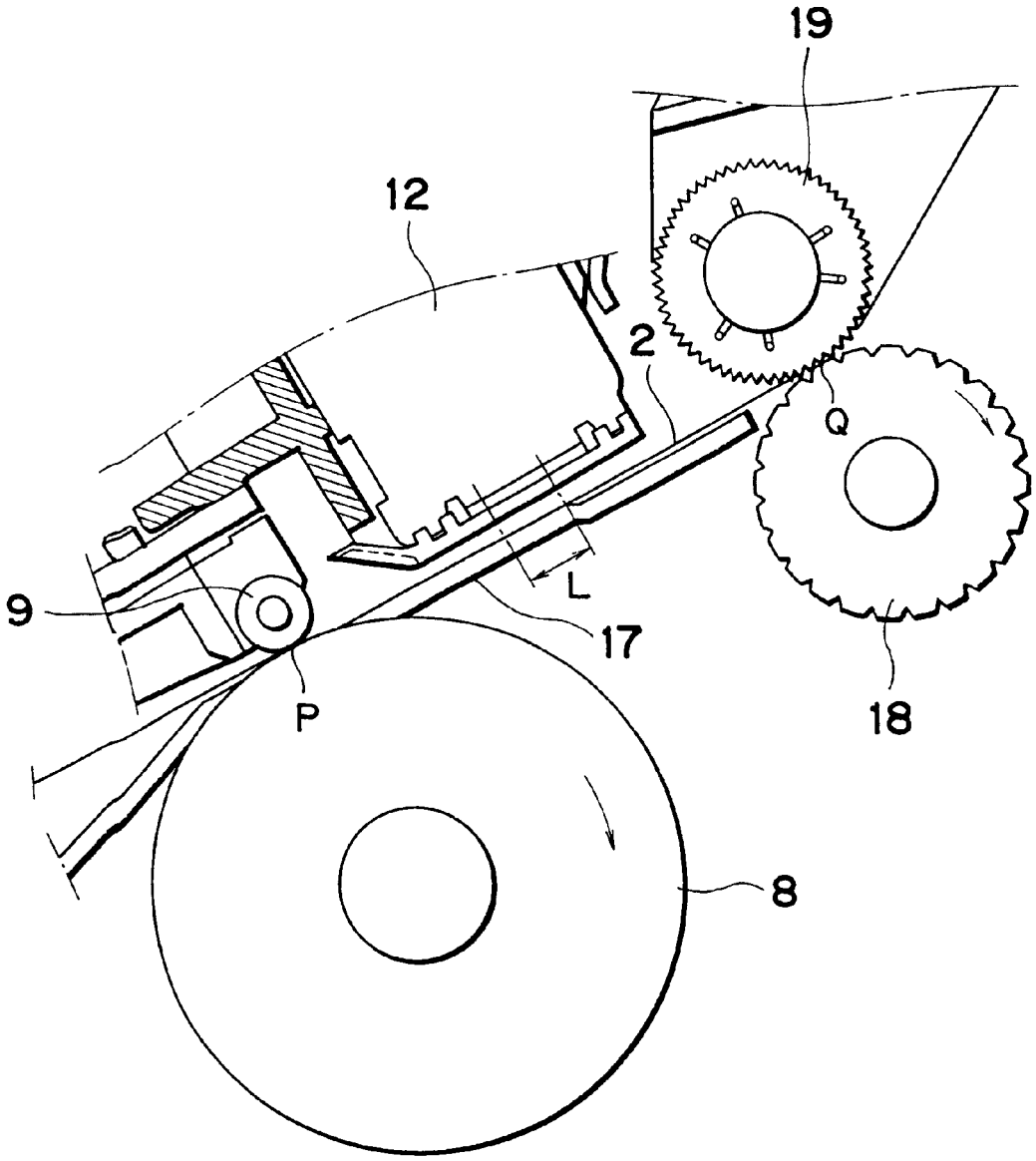
FIG. 3 illustrates a state in which, in the first embodiment, the leading end of a recording medium bears against a discharge roller.
Figure 4:
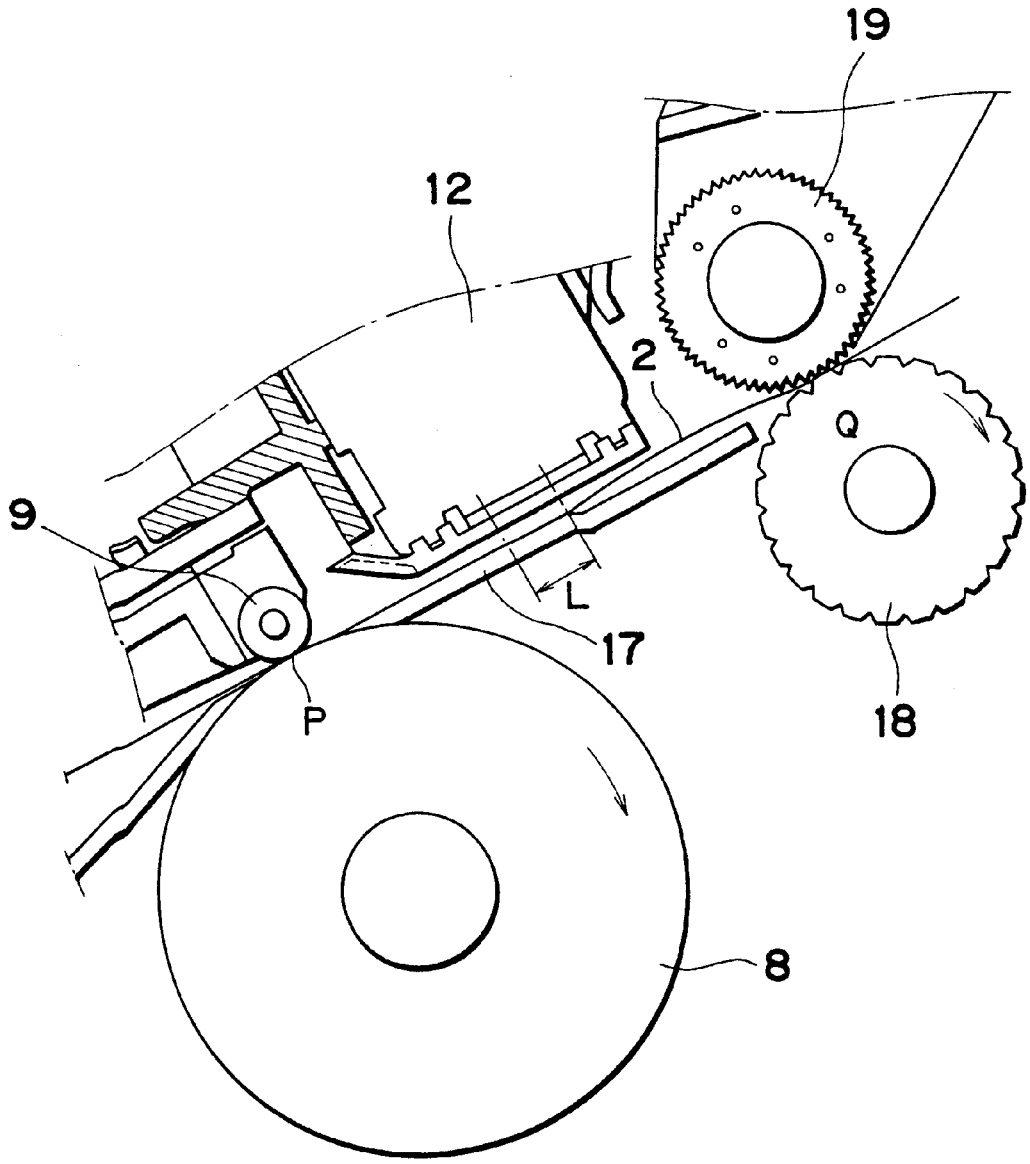
FIG. 4 illustrates a state in which, in the first embodiment, the recording medium is discharged by the discharge roller.

An embodiment of the ink jet recording apparatus of the present invention will hereinafter be described with reference to FIGS. 1 to 4. FIG. 1 is a schematic cross-sectional view showing the general construction of the recording apparatus according to the present embodiment, FIG. 2 is an enlarged illustration of the essential portions of a recording portion, FIG. 3 illustrates a state before the leading end of a recording medium bears against a discharge roller, and FIG. 4 illustrates a state in which the recording medium is discharged by the discharge roller.

(Whole Construction)

The general construction of this apparatus will first be described with reference to FIG. 1.

A plurality of recording mediums 2 are stacked on a supply stacker 1, and the uppermost one of the recording mediums 2 is brought into pressure contact with a semicircular feed roller 4 by the biasing force of a pressing spring 3. A frictional piece 6 is brought into pressure contact with the feed roller 4 by a pressing spring 5 and an idle roller 7 smaller in diameter than the feed roller 4 is mounted coaxially with the feed roller 4 so that the recording mediums 2 on the stacker 1 may be fed one by one when the feed roller 4 is rotated.

The fed recording medium 2 is conveyed in the sub-scanning direction (the direction of arrow a) by a conveying roller 8 and a follower roller 9 constituting a conveying rotatable member. The conveying roller 8 is connected to a motor (not shown) and drivingly rotatable thereby, and the follower roller 9 is rotatably mounted on a holding member 10 which is biased by a pressing spring 11, and the follower roller 9 is brought into pressure contact with the conveying roller 8. Thus, when the conveying roller 8 is rotated in the direction of the arrow, the recording medium 2 is nipped by and between the rollers 8 and 9 and is conveyed in the direction of arrow a. In synchronism with this conveyance, recording means is driven to thereby effect recording on the recording medium.

In the present embodiment, the driving means is of the serial ink jet recording type in which an ink jet recording head 12 is carried on a carriage 13 which is reciprocally moved along a carriage shaft 14 provided in the main scanning direction (the front to back direction of the drawing sheet) so that the recording head 12 may discharge ink droplets in conformity with a recording signal to thereby effect desired recording on the recording medium 2. The recording head 12 is supplied with ink from an ink tank 15 through a pipe 16.

The recording head 12 is provided with a minute liquid discharge port (opening), a liquid path, an energy acting portion provided in a portion of this liquid path, and energy generating means for generating liquid droplet forming energy caused to act on liquid in said acting portion. As the energy generating method for generating such energy, there is a recording method using an electro-mechanical conversion member such as a piezo-electric element, a recording method using energy generating means for applying an electromagnetic wave such as a laser to generate heat and causing liquid droplets to be discharged by the action of the generated heat, or a recording method using energy generating means for heating liquid by an electro-thermal conversion member such as a heat generating element having a heat generating resistance member to thereby cause liquid to be discharged. Among them, recording heads used in the ink jet recording method for causing liquid to be discharged by thermal energy permit liquid discharge ports (openings), for discharging liquid droplets for recording to thereby form liquid droplets for discharge to be arranged at high density and therefore can accomplish recording of high resolution. Among such recording heads, a recording head using an electro-thermal conversion member as energy generating means is advantageous because it can be easily made compact and its manufacture can sufficiently include most of the merits of the IC technique and the microprocessing technique, which has been advanced in the recent field of semiconductors. The improvement in the reliability of the recording head is remarkable, its high-density mounting is capable with a ease and its manufacturing cost is low.

Provision is made of a paper guide for guiding the recording medium 2 conveyed by the conveying roller 8 to determine the spacing between the recording medium 2 and the ink discharging surface of the recording head 12 during the recording, and supporting the back of the recording medium at the recording position (the portion L in FIG. 1). This paper guide 17 provides a recording position defining member for defining the position of the recording medium 2 at the recording position, and is comprised of a flat plate having a level difference in a predetermined position in the direction of conveyance of the recording medium.

The recording medium 2 on which recording has been effected by the recording means is discharged onto a discharge stacker 20 by a discharge roller 18 and a follower roller 19 constituting a discharging rotatable member. The discharge roller 18 is connected to a motor (not shown) and is drivingly rotatable thereby, and the follower roller 19 is rotatably mounted on a holding member 21 which is biased by a pressing spring 22, and the follower roller 19 can be brought into pressure contact with the discharge roller 18. Thus, when the discharge roller 18 is rotated in the direction of the arrow, the recording medium 2 is nipped by and between the rollers 18 and 19 and is discharged onto the discharge stacker 20.

In FIG. 1, the reference numeral 23 designates a recording medium detecting sensor lever provided upstream of the point of pressure contact between the conveying roller 8 and the follower roller 9 with respect to the direction of conveyance of the recording medium, and the operation of this lever 23 is detected by a photosensor 24 to thereby detect the presence or absence of the recording medium 2.

(Relation between the Points of Pressure Contact between the Pairs of Rollers and the Plane of the Paper Guide.)

In this recording apparatus, the point of pressure contact P between the conveying roller 8 and the follower roller 9, the point of pressure contact Q between the discharge roller 18 and the follower roller 19 and the paper guide 17 are disposed so as to have predetermined relations. These relations will now be described.

As shown in FIG. 2, relative to a plane (recording position defining plane) $S_1$ on which the paper guide 17 defines the position of the recording medium 2 conveyed by the conveying roller 8 at the recording position, the point of pressure contact P between the conveying roller 8 and the follower roller 9 is located on the side near the recording head 12 (in the direction of arrow b in FIG. 2 perpendicular to the plane $S_1$). Also, relative to the plane $S_1$ the point of pressure contact Q between the discharge roller 18 and the follower roller 19 is located on the side opposite to the side to which the recording head 12 belongs, i.e., the side far from the recording head 12 (in the direction of arrow c in FIG. 2 perpendicular to the plane $S_1$). Design is made such that the paper guide 17 has a level difference on the side downstream of the recording position L in the direction of conveyance of the recording medium relative to the plane $S_1$ (hereinafter referred to as "downstream side") and the point of pressure contact Q between the discharge roller 18 and the follower roller 19 lies on a plane $S_2$ on the downstream side.

Also, the follower roller 9 is disposed such that the tangential line $S_3$ on the circumference of the conveying roller 8 at the point of pressure contact P of the conveying roller 8 intersects the plane $S_1$ on the side downstream of the point of pressure contact P. Thus, the recording medium 2 being conveyed to the recording position L by the conveying roller 8 is conveyed in such a manner as be urged against the plane $S_1$ of the paper guide 17 by the rigidity of the recording medium itself, and is positioned without floating up from the paper guide 17 at the recording position L.

Further, when as shown in FIG. 2, the distance between the plane $S_1$ and the plane $S_2$ is A and the distance along the plane $S_2$ from the recording position L by the recording head 12 to the point of pressure contact Q between the discharge roller 18 and the follower roller 19 is B, A and B are set such that the relation therebetween is $$0.01 \leqq A/B \leqq 0.05.$$

The lower limit of this numerical value is determined by the effect against the bulging of the recording medium 2 caused by ink permeating into the recording medium 2, and the upper limit thereof is determined by the disturbance of the accuracy of sub-scanning conveyance by the shock when the recording medium 2 strikes against and is caught up by the discharge follower roller 19.

That is, to prevent the recording medium 2 bulged by the permeation of ink thereinto from rubbing against the recording head 12, the greater is the value of the distance A between the planes, the better, and as the value of the distance A becomes smaller, the bulged recording medium 2 becomes more liable to rub against the recording head 12 which effects main scanning. However, if the value of the distance A is made great, the shock when the leading end of the recording medium 2 strikes against the follower roller 19 becomes great and the accuracy of sub-scanning conveyance becomes liable to be disturbed. To make such shock small, it is preferable to make the value of the distance A small. Accordingly, it is desirable to set the value of A/B within such a range that the rubbing by the recording head 12 does not take place and the accuracy of sub-scanning conveyance is not disturbed.

Here is shown the result of an experiment carried out by the inventor with the value of said distance A between the two planes varied. This experiment was carried out in a recording apparatus wherein said distance B was set to 20 mm and the distance between the recording head 12 and the paper guide 17 was set to 1 mm, and use was made of copying paper comprising cut paper having a thickness of the order of 0.1 mm usually used as the recording medium 2 and 100% duty printing for which the bulging by the permeation of ink was greatest was effected and the value of said distance A was varied. At this time, the creation of the stain caused by the recording head 12 which scanned rubbing against the recording medium 2 bulged by the permeation of ink and the occurrence of the disturbance of the accuracy of sub-scanning conveyance when the leading end of the recording medium 2 struck against the follower roller 19 were as follows:

| Value of A (mm) | 0.1 | 0.2 | 0.5 | 0.8 | 1.0 | 1.1 |
|---|---|---|---|---|---|---|
| Stain | x | ○ | ○ | ○ | ○ | ○ |
| Disturbance of sub-scanning | ○ | ○ | ○ | ○ | ○ | x |

Stain (x: stain created, ○ : stain not created)

Disturbance of sub-scanning { x : disturbance occurred, ○ : disturbance did not occur }

Accordingly, it will be seen that if A is within the range of $0.2 \leqq A \leqq 1.0$ mm, the stain by the rubbing of the recording head 12 and the disturbance of the accuracy of sub-scanning conveyance do not occur. From this, it is preferable that the value of A/B be set to $0.01 \leqq A/B \leqq 0.05$ as previously described.

(Conveyance of the Recording Medium.)

The movement of the recording medium 2 when recording was effected by the recording apparatus of the above-described construction with paper used as the recording medium 2 will now be described with reference to FIGS. 3 and 4.

As previously described, the recording medium 2 is conveyed along the plane $S_1$ of the paper guide 17 by the conveying roller 8 and the follower roller 9, and desired recording is effected by the operation of the recording means. This recording medium 2 is bulged by the permeation of ink thereinto, but before the leading end thereof arrives at the point of pressure contact Q between the discharge roller 18 and the follower roller 19, the leading end of the recording medium 2 is free as shown in FIG. 3 and therefore, the recording medium dilates only in the direction of conveyance and does not expand toward the recording head 12 side. On the other hand, if recording is continued still after the leading end of the recording medium 2 after recording has arrived at the point of pressure contact Q as shown in FIG. 4, the recording medium 2 will be bulged by the permeation of ink thereinto, but the expansion thereof toward the recording head 12 side will become reduced because the point of pressure contact Q is farther relative to the recording head 12 than to the recording position defining plane $S_1$ of the paper guide 17.

Accordingly, correspondingly to the reduction in the expansion of the recording medium toward the recording head 12 side, the ink discharging surface of the recording head 12 can be brought close to the recording position defining plane $S_1$ of the paper guide 17 and as a result, it becomes possible to accomplish recording of a high quality.

[Other Embodiments]

In the aforedescribed embodiment, there has been shown an example in which the point of pressure contact P between the conveying roller 8 and the follower roller 9 is disposed more proximately to the recording head 12 than to the recording position defining plane $S_1$, but alternatively, the point of pressure contact P may be in the same plane as the plane $S_1$. That is, the recording medium 2 conveyed by the conveying roller 8 and the follower roller 9 may be intactly conveyed on the paper guide 17. Also, in the aforedescribed embodiment, the paper guide 17 has been shown as being provided with a level difference, whereas such a level difference need not always be provided, but use may be made of a paper guide flush with the recording position defining plane $S_1$. Further, in the aforedescribed embodiment, the ink jet recording system is used as the recording means, but it will be more preferable if design is made such that an electro-thermal conversion member is electrically energized in conformity with a recording signal and by the growth of a bubble created by heating exceeding the film boiling by the electro-thermal conversion member, ink is discharged from a discharge port to thereby effect recording.

Figure 5:
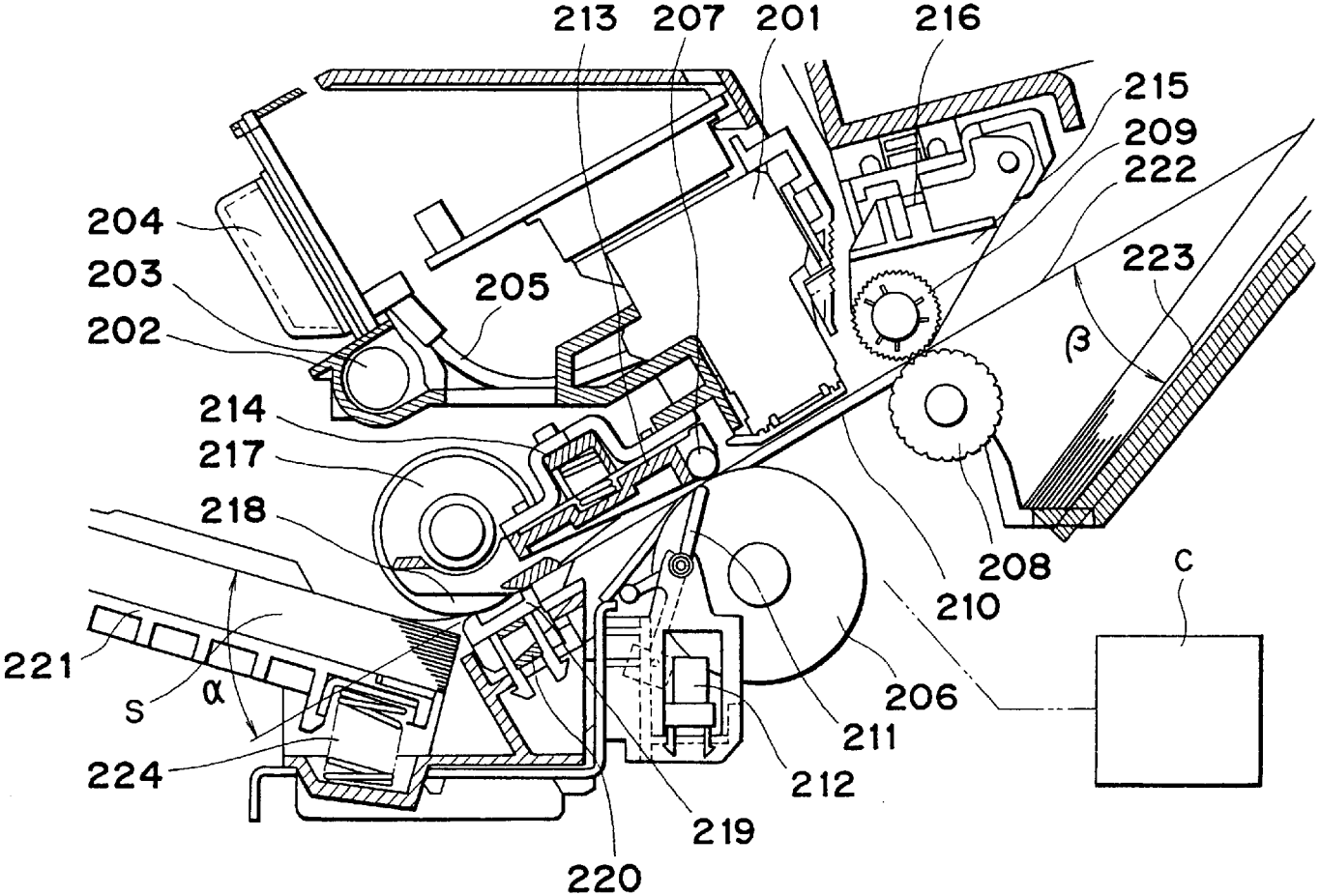
FIG. 5 is a longitudinal cross-sectional view showing the construction of a recording apparatus according to a second embodiment of the present invention.

FIG. 5 is a longitudinal cross-sectional view of another recording apparatus according to the present invention as it is seen from the direction of the main scanning axis. This is an embodiment applied to a so-called serial type recording apparatus in which recording means and a recording medium are scanned in the main scanning direction and the sub-scanning direction, respectively, to thereby effect recording.

The reference numeral 201 designates an ink jet recording head for effecting recording, the reference numeral 202 denotes a carriage carrying the ink jet recording head 201 and scanning in the main scanning direction for recording, the reference numeral 203 designates a carriage-shaft along which the carriage 202 scans, the reference numeral 204 denotes an ink tank storing therein ink to be discharged by the ink jet recording head 201, and the reference numeral 205 designates an ink pipe for supplying the ink from the ink tank 204 to the ink jet recording head 201. The reference numeral 206 denotes a conveying roller for holding a sheet S and conveying it in the sub-scanning direction, the reference numeral 207 designates a follower roller for bringing the sheet S into pressure contact with the conveying roller 206 to thereby create a conveying force, the reference numeral 208 denotes a paper discharging roller for discharging the sheet S from a recording position, the reference numeral 209 designates a paper discharging follower roller for bringing the sheet S into pressure contact with the paper discharging roller 208 to thereby create a conveying force, and the reference numeral 210 denotes a paper guide for defining a position for effecting recording on the sheet S by the ink jet head 201 provided between the conveying roller 206 and the paper discharging roller 208.

The reference numeral 211 designates a sheet sensor lever for detecting the leading and the trailing end of the sheet S provided upstream of the point of pressure contact between the conveying roller 206 and the follower roller 207 with respect to the direction of sheet conveyance, the reference numeral 212 denotes a photosensor for converting the operation of the sheet sensor lever 211 into an electrical signal, the reference numeral 213 designates a first holding member for holding the follower roller 207, the reference numeral 214 denotes a first spring for biasing the first holding member 213 and bringing the follower roller 207 into pressure contact with the conveying roller 206, the reference numeral 215 designates a second holding member for holding the follower roller 209, the reference numeral 216 denotes a second spring for biasing the second holding member 215 and bringing the follower roller 209 into pressure contact with the conveying roller 208, the reference numeral 217 designates a semicircular paper feeding roller for picking up the sheets S on a paper supply stacker 221 which will be described later during the paper feeding operation, the reference numeral 218 denotes an idle roller provided coaxially with the paper feeding roller 217 and having a diameter smaller than the diameter of the paper feeding roller 217, the reference numeral 219 designates a frictional piece adapted to be brought into pressure contact with the paper feeding roller 217 during paper feeding, the reference numeral 220 denotes a third spring for urging the frictional piece 219, the reference numeral 221 designates a paper supply stacker on which the sheets S to be printed are stacked, the reference numeral 223 denotes a discharged paper stacker on which the sheets S after being printed are stacked, and the reference numeral 224 designates a fourth spring for bringing the paper supply stacker 221 into pressure contact with the paper feeding roller 217.

The main scanning operation of the recording head 201 and the driving of the rollers 206, 208 and 217 are effected by control means C on the basis of a control program.

The operation of the above-described construction will now be described briefly.

The sheets S stacked on the paper supply stacker 221 are fed out by the paper feeding roller 217. Only the uppermost one of the fed-out sheets S is separated between the paper feeding roller 217 and the frictional piece 219 and is fed toward the recording head 201. The separated sheet S is nipped and conveyed between the conveying roller 216 and the follower roller 217, and recording is effected thereon by the recording head 201. The sheet S on which recording has been effected is nipped between the paper discharging roller 208 and the follower roller 209 and is discharged onto the discharged paper stacker 223. In this manner, recording is effected on the sheets S in succession.

The paper supply stacker 221 is provided at such a position that the sheets S are fed from a direction inclined by 90° or less toward the recording head 201 side with respect to the plane to which the paper guide 210 belongs ($\alpha<90°$). Also, the discharged paper stacker 223 is provided so that the sheets S discharged by the paper discharging roller 208 may be discharged in a direction inclined by 90° or less toward the recording head 201 side with respect to the plane to which the paper guide 210 belongs ($\beta<90°$).

By adopting such a construction, in the conveyance process of the sheet S from paper feeding to paper discharging, the sheet S can always be brought into pressure contact with the paper guide 210 by the rigidity of the sheet S, and the floating-up of the sheet S from the paper guide 210 which has heretofore been a problem can be prevented. As a result, the recording head 201 as it effects main scanning does not contact with the leading end of the sheet S and thus, the occurrence of jamming can be prevented.

Further, even after the sheet S has slipped out from between the conveying roller 206 and the follower roller 207, the sheet S never floats up and therefore, it never happens that the trailing end of the sheet S contacts the recording head 201 to thereby cause jamming.

Also, the paper guide 210 is inclined with respect to the horizontal plane, whereby there can be provided a recording apparatus which requires a small area for its installation and which is excellent in the handling of the sheets S.

In the present embodiment, the recording system has been described as an ink jet recording system in which by the growth of a bubble created by heating exceeding the film boiling by an electro-thermal conversion member, ink is discharged from a nozzle to thereby effect recording, whereas this is not restrictive, but the present invention may be applied to a recording apparatus of other recording types such as the heat transfer type.

Figure 6:
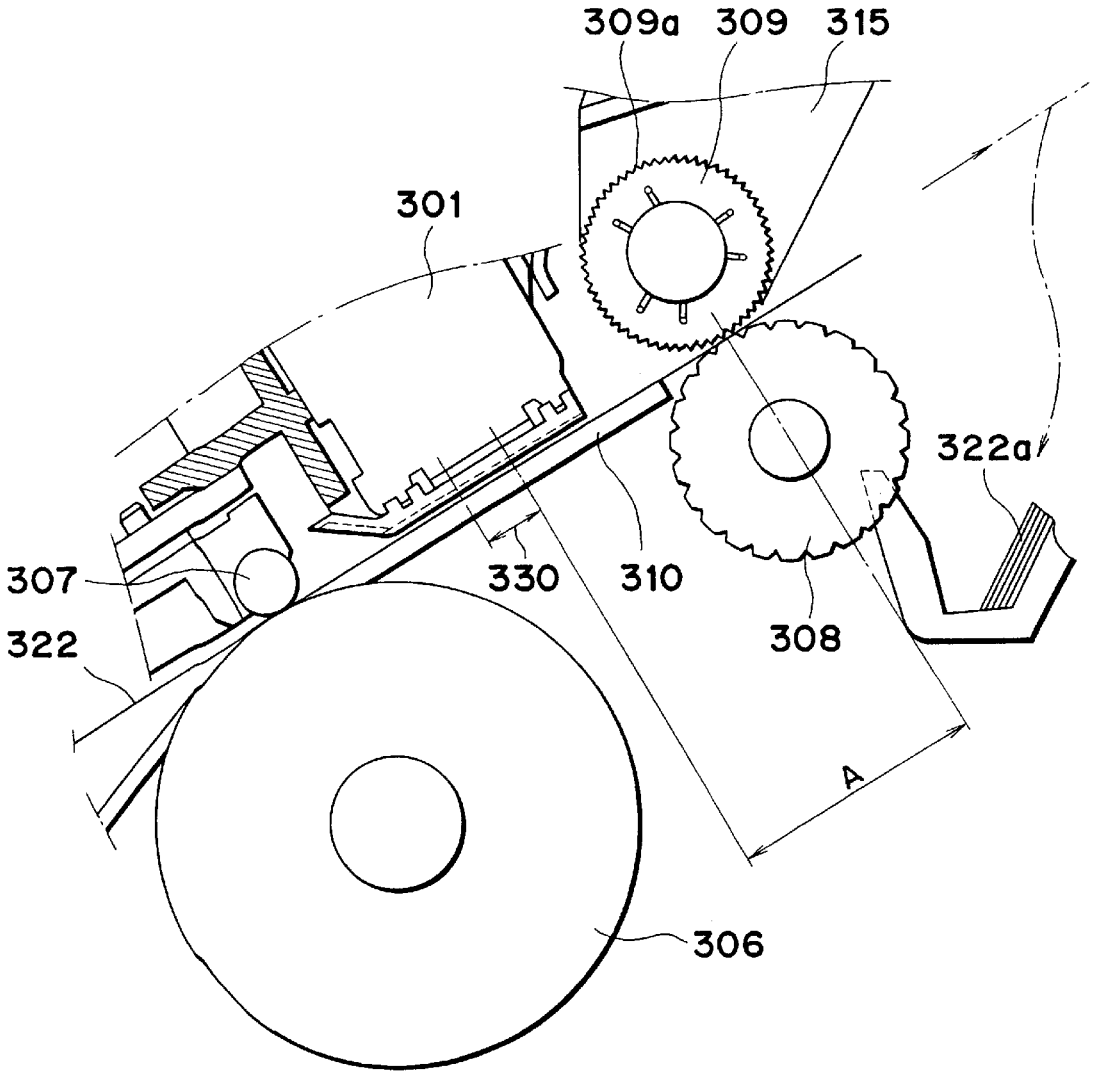
FIG. 6 is a front view showing the recording medium conveying portion of the present invention.

FIG. 6 shows the paper conveying portion of an ink jet recording apparatus according to another embodiment of the present invention. A recording medium 322 is fed between an ink jet recording head 301 and a platen 310 by a feed roller 306 and a pinch roller 307, and is printed at a printing station 330. The recording medium (sheet) 322 is further conveyed and passes between a paper discharging roller 308 and a spur 309, and the recording medium 322 which has come off the pinch roller 307 is discharged by the paper discharging roller 308 which is a driving roller and the spur 309 which is a follower side rotatable roller, and is stacked at position 322*a*.

Ink printed at the printing station 330 is not positively fixated in the distance to the spur 309, but in case of a color printer, ink adhering to a spur projection 309*a* oozes to cause print stain when it contacts the recording surface still wet with another color. To provide a construction in which it is difficult to the utmost for ink to adhere to this spur projection 309*a*, the spur is formed by the etching process. The thickness of the metallic spur formed by etching is 0.1–0.2 mm (preferably 0.3 mm or less), and the curvature of the tip end thereof is as small as R0.08 (mm) or less. The outer diameter of the spur is 15 mm, the height of the teeth thereof is 0.5 mm, and the width of the teeth is 0.7 mm. When the etching process is resorted to, the tips of the teeth can be made small and snap burrs as in the pressing process are not created. Surface treatment is applied to the SUS material subjected to the etching process to thereby further improve the wear resistance thereof with respect to coated paper.

When the wear resistance is required like this, nitriding or soft nitriding and further, carbonizing are done and the surface hardness becomes HV1000 (Vickers hardness) or greater.

(Nitriding Process)

A part was heated on the order of 560°–580° C., and nitrogen and carbon were diffused in the surface layer thereof, which thus exhibits surface hardness and wear resistance. In the present embodiment SUS304-CSPH was nitrided. As a result, its hardness (Vickers) which was about 380 HV before becoming 1000–1300 HV. The thickness of the nitrided carbon compound layer is on the order of 0.07–0.015 mm.

(Other Embodiments)

Under spur pressure of such a light load that envelopes, postcards or the like are not conveyed, if the spur is subjected to a treatment such as nickel chromium plating or hard chromium plating, the wear resistance of the tip of the spur can be improved.

(Recording Means)

The recording means used in each of the above-described embodiments records an ink image on a recording sheet conveyed thereto. The recording means may preferably be of the ink jet recording type. The recording means of the ink jet recording type is provided with a liquid discharge port for discharging therethrough recording ink as a flying liquid droplet, a liquid flow path communicating with said discharge port, and discharge energy generating means provided in a portion of said liquid flow path for giving discharge energy for causing the ink liquid in the flow path to fly. The discharge energy generating means is driven in conformity with an image signal to discharge ink droplets to thereby record an image.

As the discharge energy generating means, there is a method using the pressure energy generating means of an electromechanical conversion member such as a piezo element, a method using electromagnetic energy generating means for applying an electromagnetic wave such as a laser to ink liquid to thereby cause the ink liquid to absorb the electromagnetic wave and generate heat, and causing the ink to be discharged by the action of the generated heat, or a method using thermal energy generating means for heating ink liquid by an electro-thermal conversion member to thereby cause the ink to be discharged. Among these methods, the system using the thermal energy generating means by the electro-thermal conversion member to cause the ink to be discharged is suitable because it permits liquid discharge ports to be arranged highly densely and therefore can accomplish recording of high resolution and also can make the recording head compact. Herein, as the recording means, use is made of a serial type bubble jet recording system which is one of the aforedescribed ink jet recording systems.

Figure 7:
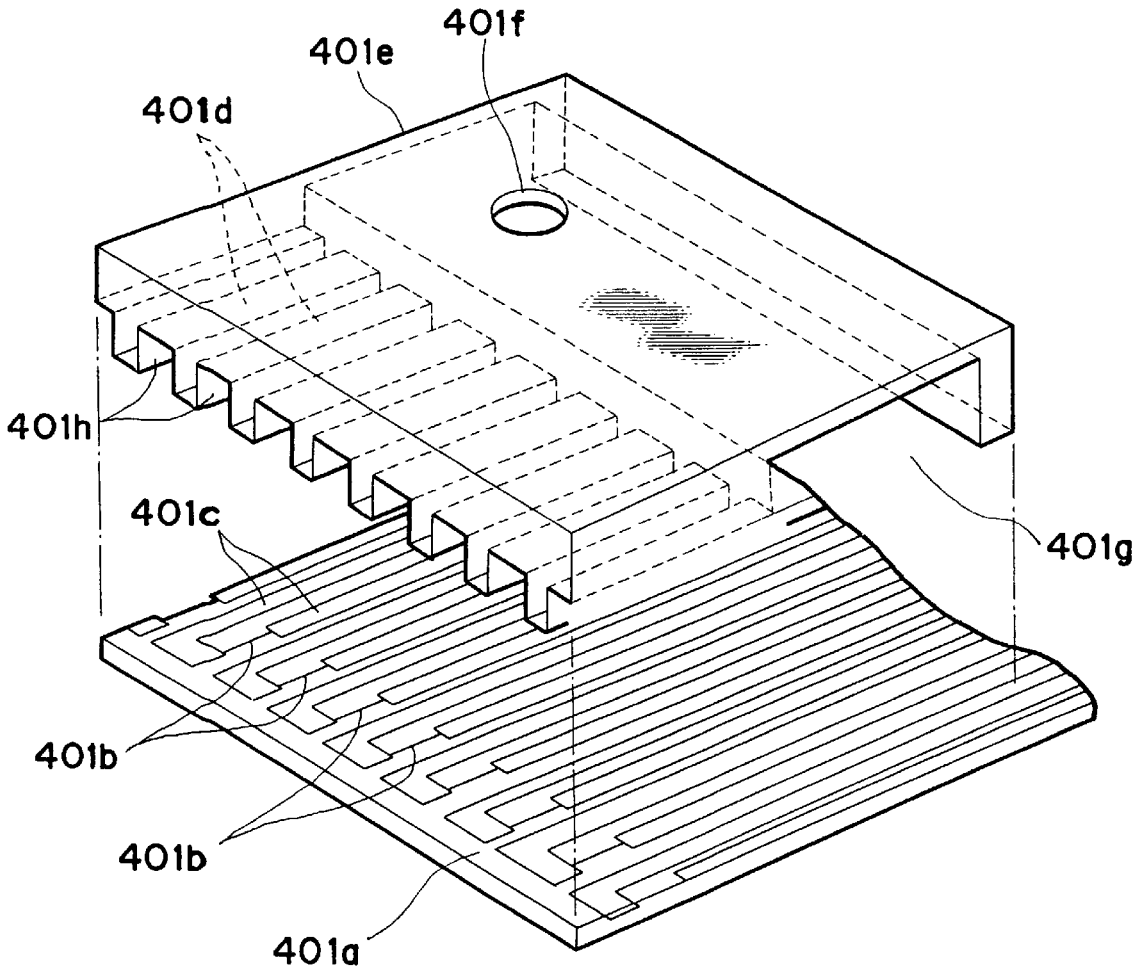
FIG. 7 is an exploded illustration showing the construction of a recording head.

FIG. 7 is an exploded illustration illustrating the construction of a recording head 401 constituting the recording means, and FIGS. 8A–8G illustrate the principle of bubble jet recording. Its typical construction and principle are disclosed, for example, in U.S. Pat. Nos. 4,723,129 and 4,740,796.

In FIG. 7, the reference character 401*a* designates a heater board comprising a silicon substrate on which are formed electro-thermal conversion members (discharge heaters) 401*b* and electrodes 401*c* of aluminum or the like for supplying electric power thereto. A top plate 401*e* having a partition wall for partitioning recording liquid paths (nozzles) 401*d* is adhesively secured to the heater board 401*a*. An ink cartridge for supplying ink to the recording head 401 is interchangeably mounted at a predetermined location. The ink supplied from the ink cartridge through a conduit is introduced through a supply port 401*f* formed in the top plate 401*e* into a common liquid chamber 401*g* in the recording head 401, and is directed from this common liquid chamber 401*g* into the nozzles 401*d*. These nozzles 401*d* are formed with ink discharge ports 401*h*, which are formed at a predetermined pitch in the direction of sheet conveyance in opposed relationship with the recording sheet at the recording head 401.

In the present embodiment, the recording head 401 of the above-described construction is carried on a reciprocally movable carriage, and ink is flyingly discharged from the recording head 401 in synchronism with the movement of the carriage to thereby effect recording.

The principle of the flying of ink in the bubble jet recording system will now be described with reference to FIGS. 8A–8G.

Figure 8A:
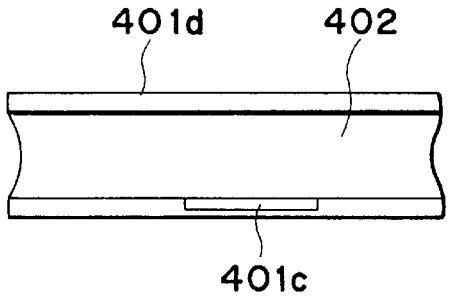
FIGS. 8A–8G illustrate the principle of bubble jet recording.
Figure 8B:
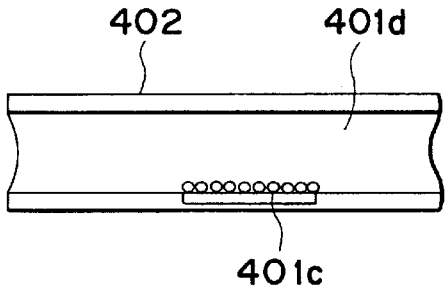
Figure 8C:
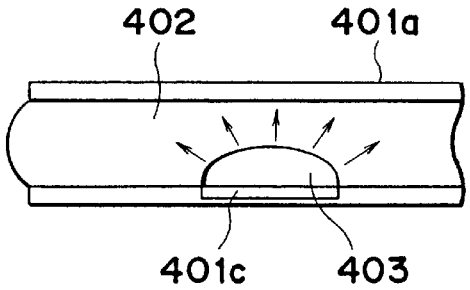

In a steady state, as shown in FIG. 8A, the ink 402 filling the nozzles 401*d* is balanced in external pressure with the surface tension in the discharge surface. When in this state, the ink 402 is to be caused to fly, the electro-thermal conversion members 401*b* in the nozzles 401*d* are electrically energized to thereby cause a rapid temperature rise exceeding nuclear boiling in the ink in the nozzles 401*d*. Thereupon, as shown in FIG. 8B, the ink adjacent to the electro-thermal conversion members 401*b* are heated to thereby create a minute bubble, and the ink in the heated portions is gasified to cause film boiling, whereby the bubble 403 grows rapidly as shown in FIG. 8C.

Figure 8D:
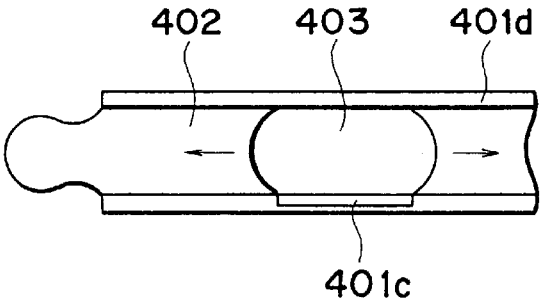
Figure 8E:
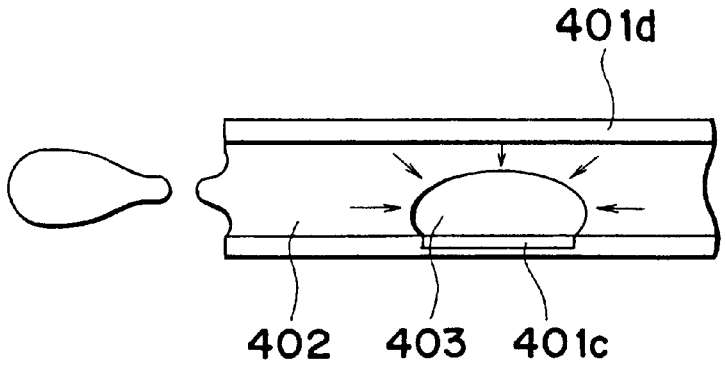
Figure 8F:
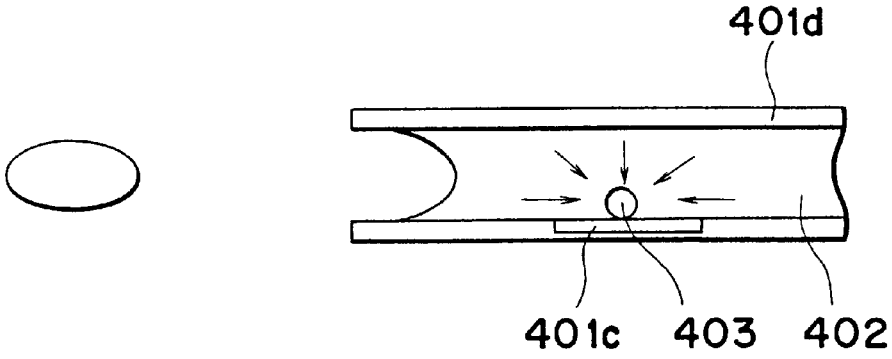
Figure 8G:
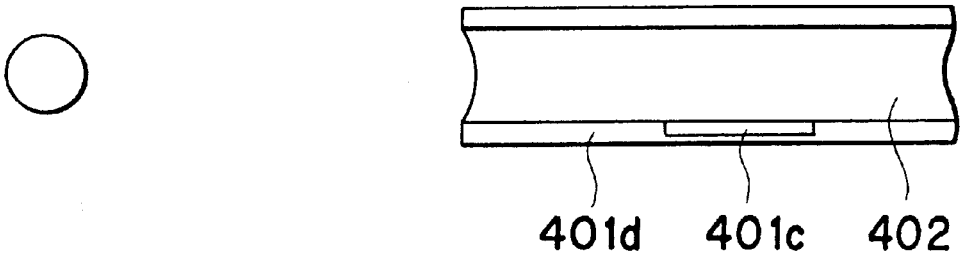
Figure 9:
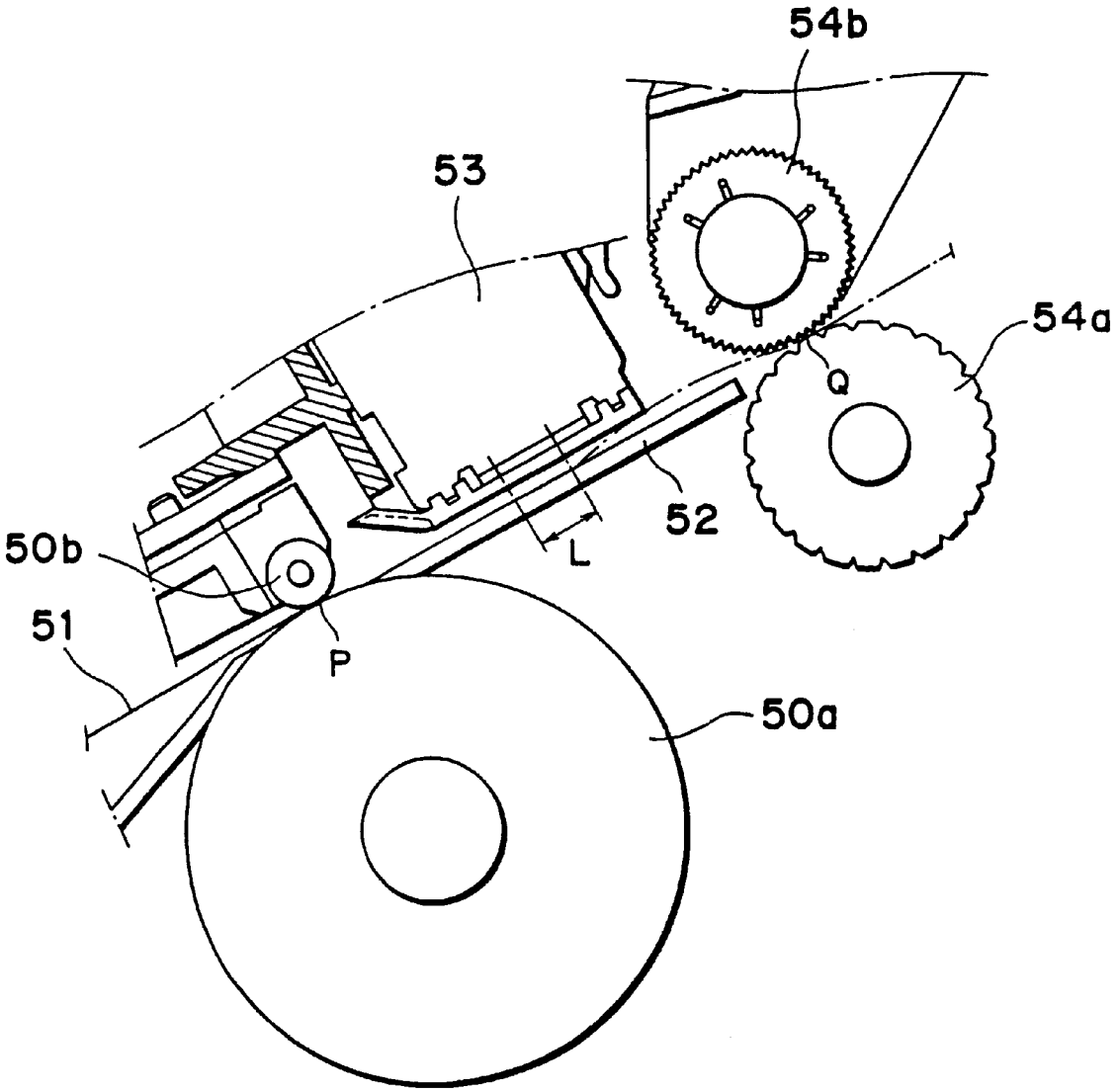
FIG. 9 PRIOR ART
FIG. 9 is an illustration of the prior art.
Figure 10:
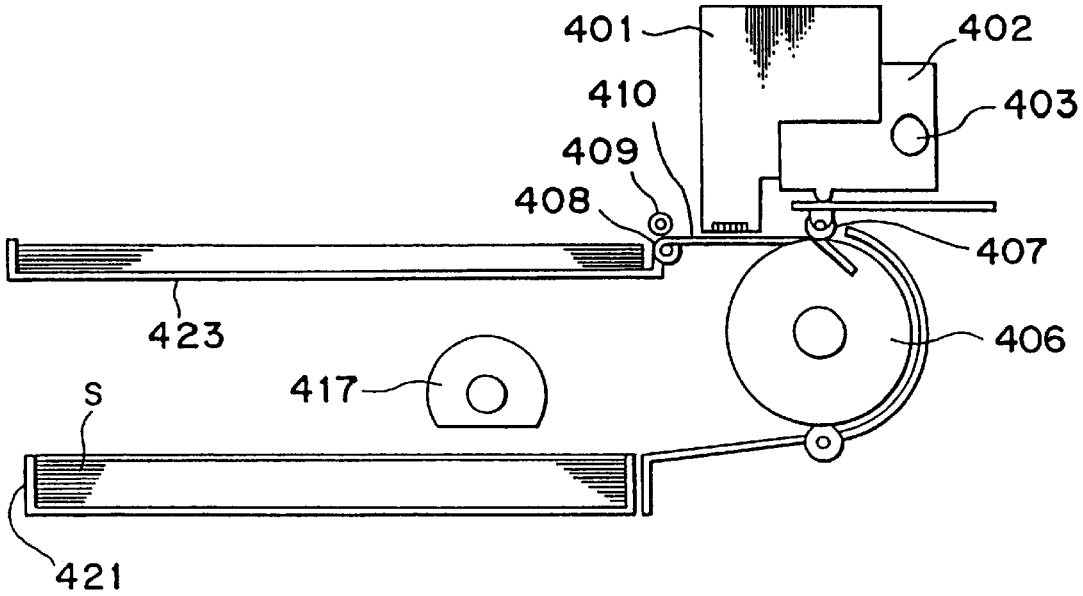
FIG. 10 PRIOR ART
FIG. 10 is a longitudinal cross-sectional view showing the construction of another recording apparatus according to the prior art.
Figure 11:
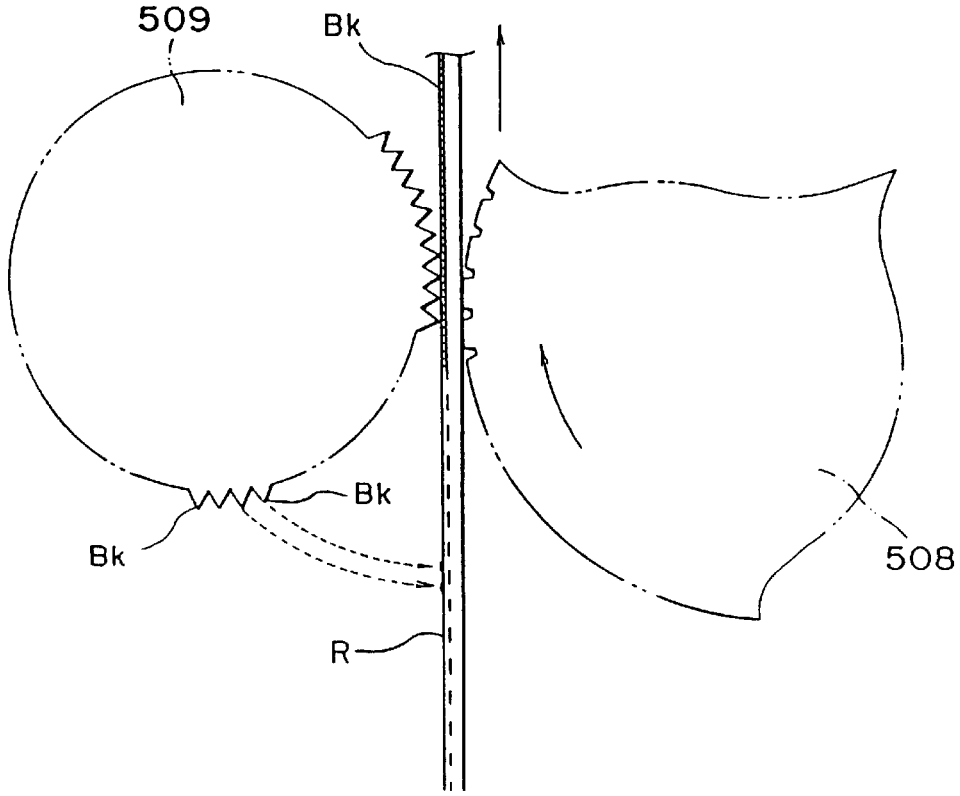
FIG. 11 shows a bad printing surface phenomenon.
Figure 12:
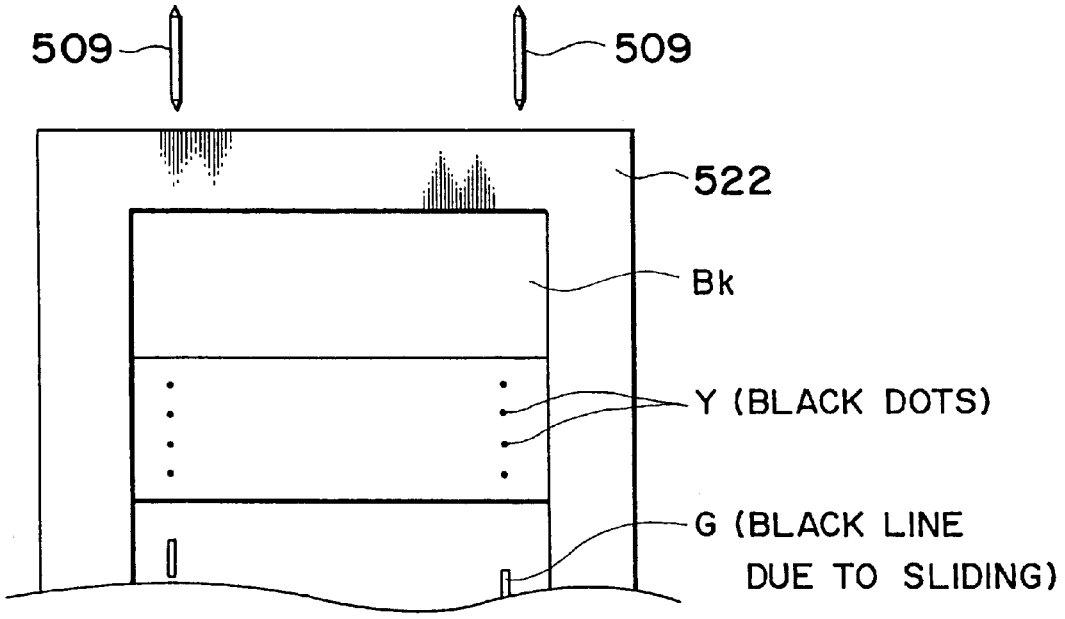
FIG. 12 shows a bad printing surface phenomenon.
Figure 13:
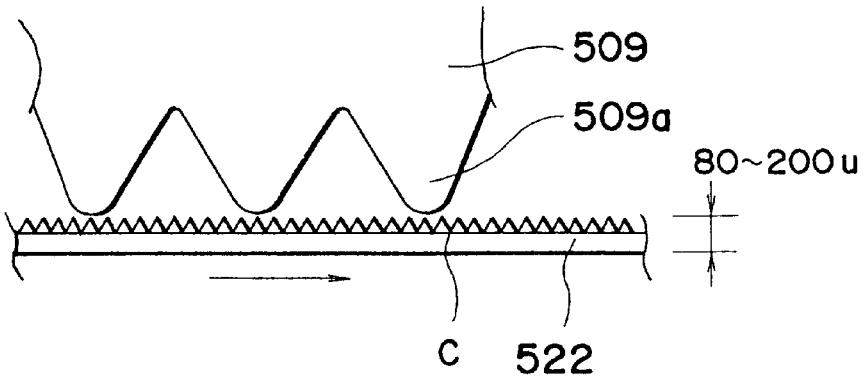
FIG. 13 shows a schematic view (a small spur projection) of OHP printing.
Figure 14:
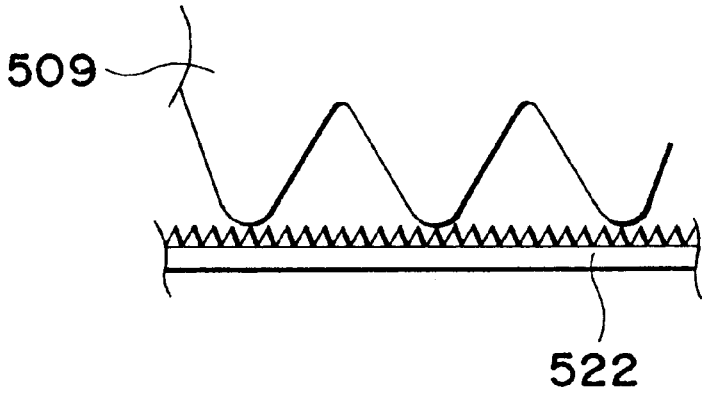
FIG. 14 shows a schematic view (the abrasion of the spur projection) of OHP printing.
Figure 15:
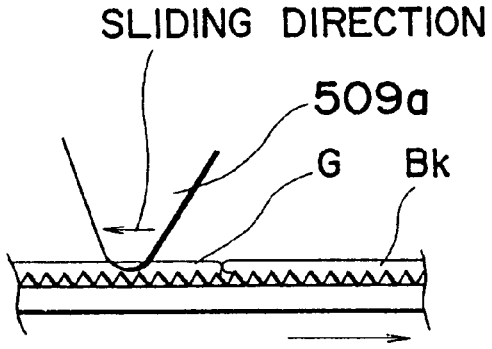
FIG. 15 shows a schematic view (sliding due to ink liquid surface) of the spur sliding of OHP printing.

When as shown in FIG. 8D, the bubble 403 grows to its largest size, an ink droplet is forced out of the discharge ports in the nozzles 401*d*. When the electrical energization of the electro-thermal conversion members 401*b* is terminated, as shown in FIG. 8E, the grown bubble 403 is cooled and shrinked by the ink 402 in the nozzles 401*d*, and due to such growth and shrinkage of the bubble, an ink droplet flies out of the discharge port. Further, as shown in FIG. 8F, the ink contacts the surface of the electro-thermal conversion members 401*b* and is rapidly cooled thereby, and the bubble 403 disappears or shrinks to an almost negligible volume. When the bubble 403 thus shrinks, as shown in FIG. 8G, the ink is supplied from the common liquid chamber 401*G* into the nozzles 401*d* due to the capillary phenomenon, and the recording head becomes ready for the next electrical energization.

Accordingly, by the carriage being reciprocally moved and the electro-thermal conversion members 401*b* being electrically energized in synchronism with said movement in conformity with an image signal, an ink image is recorded on a recording sheet.

What is claimed is:

1. A recording apparatus comprising:

a supply stacker, having a holding surface, for stacking and holding sheets;

supply means for supplying a sheet from said supply stacker;

guide means, having a flat guide surface, for guiding the sheet supplied by said supply means;

recording means, disposed at a position opposing the guide surface of said guide means, for effecting recording on the sheet guided by the guide surface; and convey means including a pair of rollers and disposed between said recording means and said supply stacker for conveying the sheet, wherein the holding surface of said supply stacker is inclined with respect to the guide surface so that the sheet supplied by said supply means, one portion of which is held by said supply stacker while another portion is guided by the guide surface, is bent due to its resiliency and is pressed onto the guide surface, and a plane determined by a supply direction of said supply means crosses with the flat guide surface of said guide means at a location upstream of an abutment point between the pair of rollers of said convey means.

2. A recording apparatus according to claim 1, wherein said guide means is inclined with respect to a horizontal plane, said supply stacker is inclined so that a downstream side thereof with respect to a direction of sheet feeding underlies an upstream side thereof, and further comprising a discharged paper stacker, which is inclined so that an upstream side thereof with respect to the direction of paper discharge underlies a downstream side thereof.

3. A recording apparatus according to claim 1, wherein said guide means is inclined so that an upstream side thereof overlies a downstream side thereof.

4. A recording apparatus according to claim 1, wherein said recording means is of an ink jet type which utilizes thermal energy generated by an electro-thermal conversion member to discharge ink and effect recording.

5. A recording apparatus according to claim 4, wherein said recording means is of an ink jet type in which ink is discharged from a discharge port by the growth of a bubble created by heating exceeding film boiling by the electro-thermal conversion member, to thereby effect recording.

6. A recording apparatus comprising:

a supply stacker having a holding surface for stacking and holding a sheet;

a supply rotary member for supplying the sheet from the supply stacker;

a guide member having a flat guide surface for guiding the sheet supplied by said supply rotary member;

a recording head provided at a position facing the guide surface for recording an image on the sheet guided by the guide surface; and a convey member including a pair of rollers and disposed between said recording head and said supply stacker for conveying the sheet, wherein the holding surface is inclined relative to the guide surface, one portion of the sheet supplied by said supply rotary member being positioned on said supply stacker and another portion being guided by said guide member, so that the sheet is bent in a direction along an outer peripheral surface of said supply rotary member to be pressed onto the guide surface due to its resiliency between said supply stacker and the guide surface and a plane determined by a supply direction of said supply rotary member crosses with the flat guide surface of said guide member at a location upstream of an abutment point between the pair of rollers of said convey member.

7. A recording apparatus comprising:

a supply stacker, having a holding surface, for stacking and holding sheets;

supply means for supplying a sheet from said supply stacker;

guide means, having a flat guide surface, for guiding the sheet supplied by said supply means;

recording means, disposed at a position opposing the guide surface of said guide means, for effecting recording on the sheet guided by the guide surface; and convey means including a pair of rollers and disposed between said recording means and said supply stacker for conveying the sheet, wherein the holding surface of said supply stacker and the flat guide surface of said guide means define a V-shaped convey route, and said convey means is disposed at a valley portion of the V-shaped convey route for feeding the sheet, and the sheet supplied by said supply stacker, one portion of which is held by said supply stacker while another portion is guided by the guide surface, is bent due to resiliency of the sheet and is pressed onto the guide surface.

8. A recording apparatus according to claim 7, wherein said guide means is inclined with respect to a horizontal plane, said supply stacker is inclined so that a downstream side thereof with respect to a direction of sheet feeding underlies an upstream side thereof, and further comprising a discharged paper stacker, which is inclined so that an upstream side thereof with respect to the direction of paper discharge underlies a downstream side thereof.

9. A recording apparatus according to claim 7, wherein said guide means is inclined so that an upstream side thereof overlies a downstream side thereof.

10. A recording apparatus according to claim 7, wherein said recording means is of an ink jet type which utilizes thermal energy generated by an electro-thermal conversion member to discharge ink and effect recording.

11. A recording apparatus according to claim 10, wherein said recording means is of an ink jet type in which ink is discharged from a discharge port by the growth of a bubble created by heating exceeding film boiling by the electro-thermal conversion member, to thereby effect recording.

12. A recording apparatus comprising:

a supply stacker having a holding surface for stacking and holding a sheet;

a supply rotary member for supplying the sheet from the supply stacker;

a guide member having a flat guide surface for guiding the sheet supplied by said supply rotary member;

a recording head provided at a position facing the guide surface for recording an image on the sheet guided by the guide surface; and a convey member including a pair of rollers and disposed between said recording head and said supply stacker for conveying the sheet, wherein the holding surface of said supply stacker and the flat guide surface of said guide member define a V-shaped convey route, and said convey member is disposed at a valley portion of the V-shaped convey route for feeding the sheet, and one portion of the sheet supplied by said supply rotary member being positioned on said supply stacker and another portion being guided by said guide member, so that the sheet is bent in a direction along an outer peripheral surface of said supply rotary member to be pressed onto the guide surface due to resiliency of the sheet between said supply stacker and the guide surface.

* * * * *

UNITED STATES PATENT AND TRADEMARK OFFICE

CERTIFICATE OF CORRECTION

PATENT NO. : 5,988,809

DATED : November 23, 1999

INVENTOR(S) : YOKOI ET AL.

It is certified that error appears in the above-identified patent and that said Letters Patent is hereby corrected as shown below:

On the title page, item:

[56] References Cited:
U.S. PATENT DOCUMENTS,
"5,170,183 12/1992 Hirabayoshi et al." should read
--5,170,183 12/1992 Hirabayashi et al.--.

COLUMN 1:
Line 56, "the" should be deleted.

COLUMN 6:
Line 6, "a" should be deleted.
Line 67, "as be" should read --as to be--.

COLUMN 9:
Line 1, "carriage-shaft" should read --carriage shaft--.
Line 22, "leading" should read --leading end--.

COLUMN 12:
Line 57, "flat" should be deleted.

COLUMN 13:
Line 6, "flat" should be deleted.
Line 34, "flat" should be deleted.
Line 52, "flat" should be deleted.
Line 61, "flat" should be deleted.

UNITED STATES PATENT AND TRADEMARK OFFICE

CERTIFICATE OF CORRECTION

PATENT NO. : 5,988,809

DATED : November 23, 1999

INVENTOR(S) : YOKOI ET AL.

It is certified that error appears in the above-identified patent and that said Letters Patent is hereby corrected as shown below:

COLUMN 14:

Line 8, "flat" should be deleted.
Line 41, "flat" should be deleted.
Line 50, "flat" should be deleted.

Signed and Sealed this

Sixth Day of March, 2001

Nicholas P. Godici

*Attest:*

NICHOLAS P. GODICI

*Attesting Officer*

*Acting Director of the United States Patent and Trademark Office*